United States Patent [19]

Evans et al.

[11] 4,125,167

[45] Nov. 14, 1978

[54] BIG HOLE BIT

[75] Inventors: Robert F. Evans, La Habra; James H. Allen, Lakewood, both of Calif.

[73] Assignee: Smith International, Inc., Newport Beach, Calif.

[21] Appl. No.: 803,700

[22] Filed: Jun. 6, 1977

[51] Int. Cl.[2] ..... E21C 9/00; E21C 7/06

[52] U.S. Cl. ..... 175/65; 166/65 M; 175/311; 175/328; 299/8; 294/65.5

[58] Field of Search ..... 175/65, 308–313, 175/316, 328; 166/65 M; 299/8, 9; 74/467, 468; 294/65.5

[56] References Cited

U.S. PATENT DOCUMENTS

| | | | |
|---|---|---|---|
| 474,297 | 5/1892 | Hoffman | 175/328 |
| 2,734,767 | 2/1956 | Donham | 166/65 M X |
| 2,982,367 | 5/1961 | Kucera | 175/328 |
| 3,011,819 | 12/1961 | Moseley, Jr. | 294/655 |
| 3,227,216 | 1/1966 | Bumpers | 166/65 M |
| 3,384,191 | 5/1968 | Schumacher, Jr. et al. | 175/340 |
| 3,762,486 | 10/1973 | Grovenburg et al. | 175/313 |
| 3,776,593 | 12/1973 | Kuhlmann-Schaefer et al. | 299/8 |

FOREIGN PATENT DOCUMENTS

| | | | |
|---|---|---|---|
| 311,343 | 7/1917 | Fed. Rep. of Germany | 294/65.5 |

*Primary Examiner*—Ernest R. Purser
*Assistant Examiner*—Richard E. Favreau
*Attorney, Agent, or Firm*—Knobbe, Martens, Olson, Hubbard & Bear

[57] ABSTRACT

A large diameter drill bit having a plurality of rolling cutters is provided with permanent magnets mounted on flexible flaps to collect magnetic debris on the bottom of a drill hole. A flap carrying a permanent magnet is mounted adjacent each cutter, or flaps carrying magnets are formed in a radially extending row to sweep the bottom of the hole as the bit rotates. In another form, magnets are included in wheels which roll on the bottom of the hole to collect the magnetic debris.

17 Claims, 8 Drawing Figures

BIG HOLE BIT

This invention relates to the removal of debris from the bottom of a hole in earth boring operations and particularly to large diameter holes.

In the recent past, the art of rotary drilling in large diameter earth boring operation has progressed rapidly. Hole sizes have increased from 36 inches to 20 feet and depths have increased from 500 to over 6,000 feet. These holes are usually cut by rotating a large diameter bit carrying on its lower end a plurality of rolling cutters which cut and crush the rock. One of the critical engineering problems in such large diameter drilling operations is the adequate removal of the drill cuttings. It is important that the cuttings be quickly removed to prevent interference with continued drilling and to minimize tool wear.

A variety of methods have been used to remove the cuttings by circulating fluid down the hole and over the hole bottom to transport the cuttings out of the hole. In one approach drilling fluid is continuously circulated in the so-called reverse direction wherein it travels downwardly around the periphery of the drill bit and is then drawn upwardly through a center pick-up in the drill bit. It is difficult to obtain sufficient fluid velocity on center pick-up bits to adequately move the cuttings. The ideal or theoretical fluid velocity to pick-up most materials in horizontal movement is six hundred feet per minute. However, data is available that indicates that gravel particles between 0.2 inches in diameter to 0.7 inches in diameter can be transported horizontally in the turbulent flow with fluid velocities ranging from 190 to 250 feet per minute. The specific gravity of these particles would range from 2.4 to 2.6 grams per cubic centimeter.

When drilling with large diameter bits in medium-hard to hard formations, either sintered tungsten carbide insert cutters or high carbon, hardened steel tooth cutters are used. The insert cutters have insert breakage and the steel tooth cutters have chippage and breakage as the teeth wear. The tungsten carbide inserts have a specific gravity of approximately 14. The particles broken or chipped from steel tooth cutters have a specific gravity of approximately 7. These tooth particles ranging in size from three-eighths of an inch to one-eighth of an inch in diameter fall to the hole bottom and are reground to very fine particle size before they become small enough to be transported by the low fluid velocities under the outer two-thirds of the bit radius. The broken tooth or insert debris on the hole bottom causes additional tooth and insert breakage and bearing seal life reduction or failure before they are ground fine enough to be removed. During long drilling operations, a considerable layer of dense particles will accumulate on the bottom of the hole. Cases have been observed where magnetic material bodies large enough to lock a rolling cutter have caused cutter skidding in which case the cutting teeth or inserts are worn smooth and a portion of the bottom goes uncut. Thus, a need exists to improve this operation.

In accordance with the present invention, magnetic means are mounted on the lower end of the drill bit to be moved closely adjacent to the bottom of the drill bore as the drill bit rotates to attract magnetic debris in the hole. Cemented tungsten carbide containing cobalt, and of course the all steel teeth, are magnetic so that most of the metallic debris on the bottom of the hole can be attracted magnetically as generated, and held out of the path of the cutters. When the bit is next withdrawn from the hole, the accummulated particles can be manually removed.

Preferably the magnetic means is mounted on a flexible flap attached to the bottom of the drill bit. The flaps position the magnetic elements close to the bottom of the hole and yet can flex out of the way of rock or other impediments. In one arrangement, a flexible flap is mounted adjacent each of the cutters preferably located to lead the cutter as the drill bit rotates. This minimizes the amount of magnetic debris to be engaged by the cutter.

In another arrangement, the fluid flow through the drill hole is downwardly around the periphery of the drill bit and upwardly through a hole in the center of the drill bit. The central hole is connected to a radially extending pick-up slot that sweeps the bottom of the hole as the drill bit rotates. The magnetic elements may be mounted on a flexible flap which is located adjacent the pick-up slot so that the magnetic elements trail the pick-up to attract whatever magnetic particles are not swept away by the drilling fluid. An inwardly extending row of magnetic elements may also be employed for the arrangement wherein the pick-up is only through the center of the drill bit.

In yet another form of the invention, tires or wheels including magnetic means are mounted on the bottom of the bit to roll on the bottom of the hole. Magnetic cuttings are attracted to the periphery of the wheel and may be scraped from the wheel by a hopper positioned adjacent the wheel periphery. Such pick-up wheels may be located where desired such as adjacent each cutter or in a radially extending row.

For a more thorough understanding of the invention, refer now to the following detail description and drawings in which.

Figure 1:
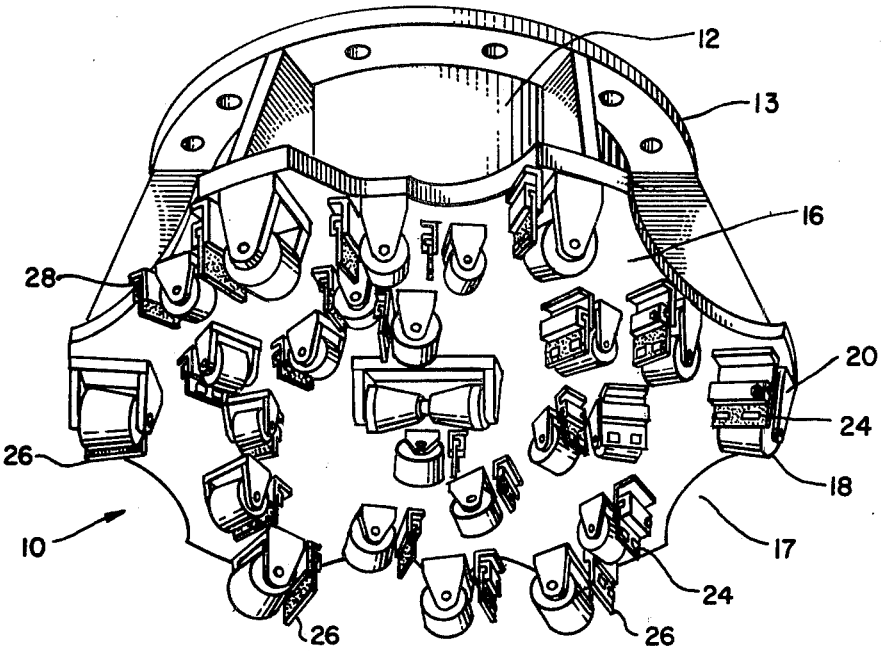
FIG. 1 is a bottom perspective view of a large diameter drill bit having a plurality of cutters with magnetic means located adjacent each of the cutters.
Figure 3:
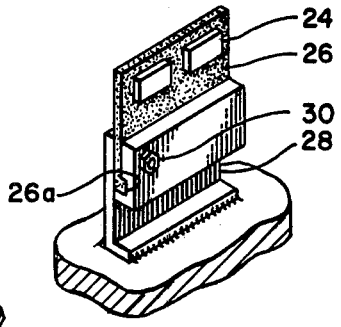
FIG. 3 is a perspective view of one of the flexible flaps carrying magnetic means as used in FIGS. 1 and 2.
Figure 2:
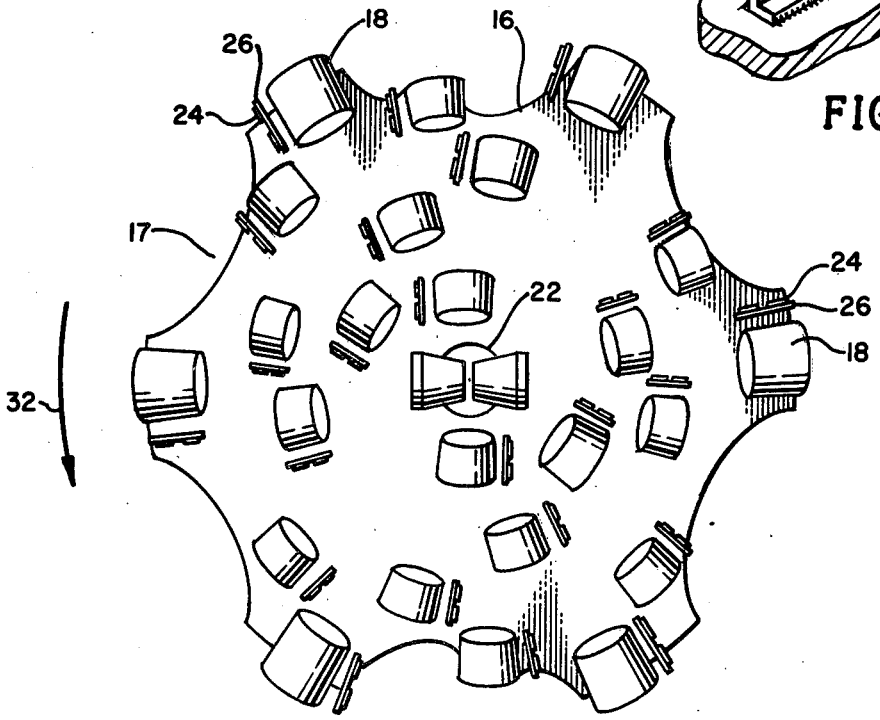
FIG. 2 is a bottom plan view of the cutter of FIG. 1 more clearly illustrating the arrangement of the magnetic means.

Referring now to FIGS. 1-3, there is shown a large diameter drill bit assembly 10 including a drill bit body 12 having a flange 13 for attachment to means for rotating the assembly. On the lower end of the drill bit body is a large horizontally extending plate 16 carrying a plurality of cutters 18. Each cutter is rotatably mounted on a suitable support 20 which is welded or otherwise suitably attached to the horizontal plate 16. The cutters 18 being of conventional variety are only schematically illustrated. It should be understood that each cutter is provided with a plurality of cutting teeth that are either milled from steel and integral with the rest of the cutter or are tungsten carbide inserts.

In operation, the drill bit assembly 10 is rotated with the cutters 18 in contact with the bottom of the drill bore. The rotation of the drill bit causes each cutter to rotate on its axis to perform the cutting function operation. To remove the cuttings, drilling fluid is continuously circulated through the bottom of the hole in accordance with known techniques. In one arrangement, the so-called reverse circulating method, drilling fluid is circulated downwardly around the periphery of the plate 16 through the recesses 17 in the periphery of the plate. The fluid then moves horizontally between the plate 16 and the bottom of the hole carrying the cuttings upwardly through a hole 22 in the center of the drill bit body 12.

To transport the cuttings adequately, the drilling fluid must be circulated at a high velocity and there must be sufficient flow to carry the accumulated cuttings. Because of the larger area, across the outer portions of the drill bit plate, the velocity in that area is less than near the center of the drill bit. As explained above, it has been found that the denser particles are not adequately removed and hence, remain on the bottom of the hole and can cause damage to the cutters and to the cutter bearings. Most of these denser particles come from chips from steel cutter teeth or from broken tungsten carbide insert teeth. These particles are magnetic, and in accordance with the invention, they are magnetically removed from the path of the cutters.

For this purpose, there is provided suitable magnetic means mounted on the plate 16 to attract the magnetic particles. In one arrangement, permanent magnets 24 are attached by bolts or other suitable means to a flexible flap 26 made of rubber-like material which can withstand the environment at the bottom of a drill hole. One edge of the flap 26 is connected to the bottom plate 16 by suitable means so that the opposite edge can move. In the arrangement shown in FIG. 3, the edge of the flap 26 fits within a slot in a bracket 28 which is welded or otherwise suitably attached to the plate 16. The flap is shown as having a rib **26*a* which fits within a mating groove in the bracket 28 so that the flap may be slipped edgewise into the bracket and held there by the rib and groove arrangement. To further attach the flap to the bracket, a suitable nut and bolt fastening means 30** is employed.

A bracket 28 is positioned adjacent each of the cutters 18 except the two center ones where the drilling fluid velocity is adequate to prevent buildup of the cuttings. The brackets 28 are positioned on the side of the cutters to lead the cutters as the drill bit is rotated so as to remove magnetic particles in the path of the cutter. Thus, with the drill bit assembly rotating in the direction indicated by the arrow 32 in FIG. 2, it can be seen that the magnetic members 24 will precede the cutters during rotation.

When the drill bit assembly 10 is removed from the drill hole, the accumulated magnetic particles may be mechanically scraped from the magnetic means 24. The strength of permanent magnets available today is such that a considerable quantity of magnetic particles can be captured by moving the magnets over the bottom of the drill hole. It is preferable that the magnets be closely spaced from the theoretical or clean hole bottom so as to facilitate the attraction of the magnetic particles but at the same time minimize direct engagement with the cuttings and hence, wear and tear on the magnets. Use of the flexible flaps permit the magnets to be moved out of the path of most obstructions so that breakage of the magnets is kept to a minimum.

It should be understood that the shape, number and strength of the magnets may be varied as desired. Similarly, the positioning of the magnets on the flexible flaps may be varied to optimize their ability to attract the magnetic particles. If centrifugal force produced by the rotation of the drill bit should cause some magnetic particles to be thrown radially outwardly off of the magnets, a suitable shield may be provided to prevent this. Also, the magnets themselves may be positioned to best accommodate such condition if desired.

Figure 4:
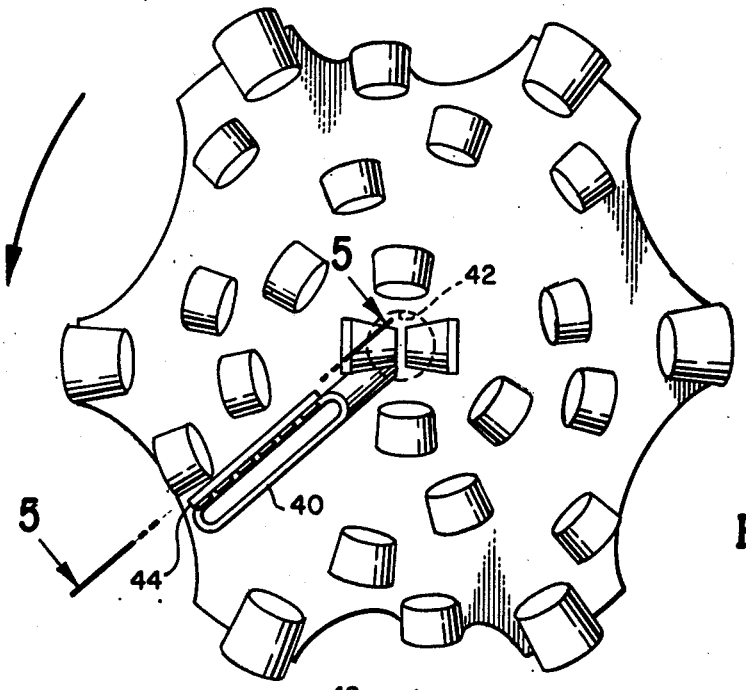
FIG. 4 is a plan view of an alternative arrangement employing a radially extending pick-up tube with magnetic means positioned adjacent the tube.
Figure 5:
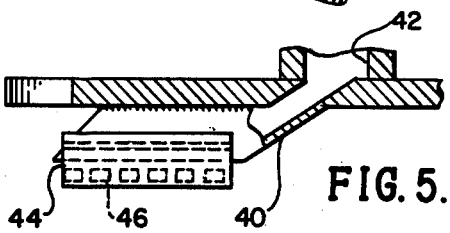
FIG. 5 is a fragmentary elevational view on line 5—5 of FIG. 4.

Referring now to FIGS. 4 and 5, some drill bit assemblies employ what is known as a sweep pick-up for the drill cuttings. In this arrangement, a radially extending slot-like tube 40 is attached to the bottom of the drill bit. The tube is connected to the center hole 42 in the drill bit. Thus, as the bit rotates, the tube 40 sweeps over the bottom of the drill bore to withdraw the cuttings. With such an arrangement, the problem of reduced velocity of the drilling fluid around the outer periphery of large diameter bits is minimized in that the velocity into the tube is increased by the reduced cross-sectional area of the drill tube.

Nevertheless, there is still the need for the magnetic arrangement of the invention to attract the denser magnetic particles which are not withdrawn by the drilling fluid. In this version of the invention, an elongated flexible flap 44 is shown positioned on one edge of the pick-up tube and a plurality of permanent magnets 46 are suitably attached to the lower edge of the flexible flap as best seen in FIG. 5. Thus, as the drill bit rotates, the magnetic particles are attracted to the permanent magnets which are moved closely spaced from the bottom of the hole. In this arrangement, the magnets are located on the trailing edge of the pick-up tube to remove the denser magnetic particles which are not removed by the pick-up tube.

Figure 6:
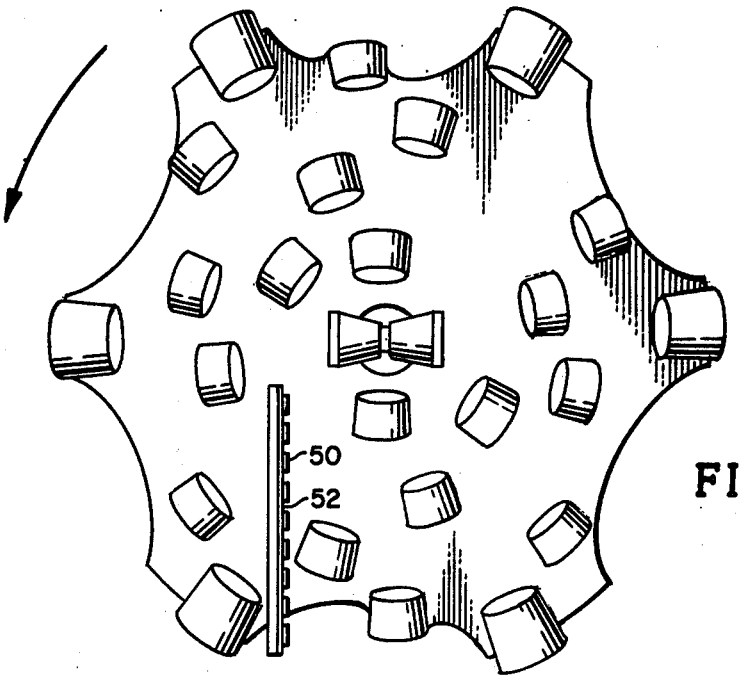
FIG. 6 is a plan view of another form of the invention wherein the magnetic means are arranged in a series extending inwardly from the periphery of the drill bit.

In FIG. 6, a plurality of permanent magnets 50 are mounted on flexible flap means 52 arranged in a single line extending inwardly from the periphery of the drill bit, somewhat like that of FIGS. 4 and 5, without the pick-up tube.

Figure 7:
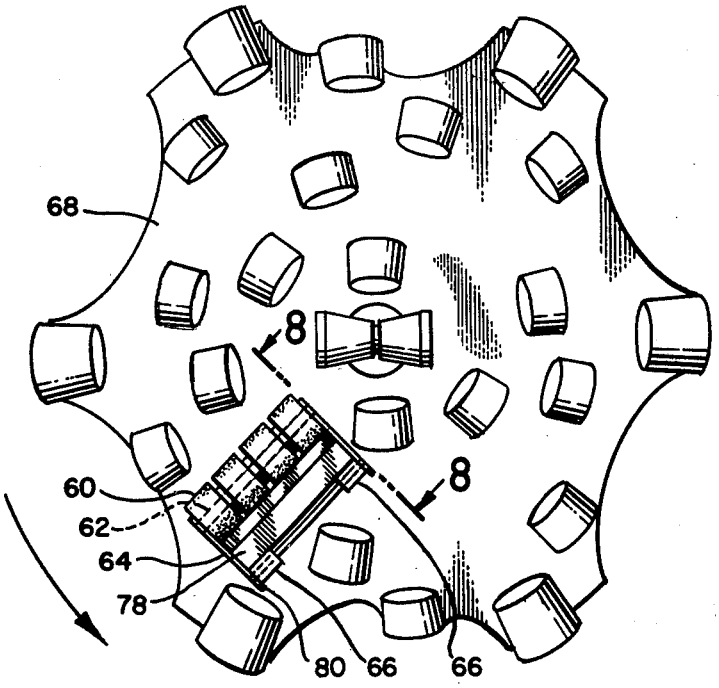
FIG. 7 is a plan view of an embodiment of the invention wherein the magnetic means are mounted on wheels which roll on the bottom of the drill bore.
Figure 8:
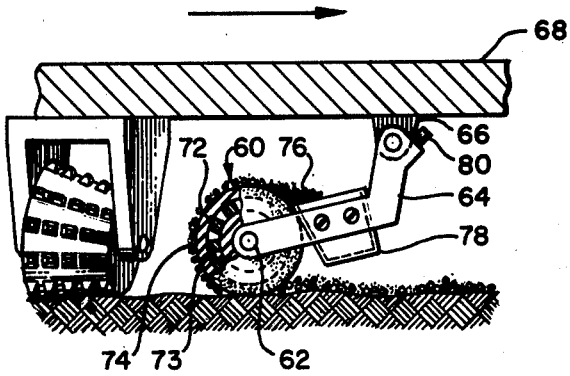
FIG. 8 is a fragmentary elevational view of the structure of FIG. 7 on lines 8—8.

Turning now to FIGS. 7 and 8, there is shown a row of tires or wheels 60 which are rotatably mounted on an axle 62 carried by a frame 64 which is pivotally attached to a bracket 66 welded or otherwise suitably attached to the bottom plate 68 of a drill bit. As schematically illustrated in FIG. 8, there is positioned in each of the wheels 60 a plurality of permanent magnets 72 separated by suitable non-magnetic spacers 73 and covered by an outer layer 74 of suitable material which can withstand the environment on the bottom of the drill hole. The magnets will attract magnetic particles 76 and hold them against the outer layer 74 as the wheels are rolled over the bottom 76 of the drill bore.

To remove the particles from the wheels, there is provided a hopper 78 supported on the frame 64 having one edge adjacent the wheels such that the particles are scraped from the periphery of the wheels by the edge of the hopper as the wheels rotate. The hopper can, of course, be emptied when the bit is removed from the drill hole.

In the arrangement shown, the wheels simply rest on the bottom of the drill hole by gravity since the weight of the permanent magnets is substantial. If desired, spring means may also be incorporated into the mounting arrangement to urge the wheels more positively against the bottom of the drill bore. With the pivotally mounted arrangement for the wheel supporting frame, the wheels can move up and down so as to move past minor obstructions and to adjust to the hole bottom 76. To maintain the hopper in a generally upright position when the drill bit is being removed from the hole, there is provided a stop pin 80 on the frame adjacent the mounting pivot pin. This stop will engage the lower plate 18 of the drill bit to limit downward movement of the hopper.

The wheels 60 are shown mounted on a single axle 62 extending radially to cover most of the bottom of the hole as the drill bit rotates. However, it should be understood that the pick-up wheels may be individually mounted where desired such as adjacent each cutter. Since the wheels travel in different paths, they, of course, rotate independently of each other to accommodate their different rotational speeds. Similarly, the periphery of the wheels may be tapered to accommodate the difference in travel between the radially inner end and the radially outer end. For simplicity purposes, such refinements are not illustrated in the drawings.

What is claimed is:

1. A big hole drill bit assembly comprising:

a drill bit body for connection to means for rotating the assembly during a drilling operation, said drill bit body including a lower portion having a generally flat lower surface of a diameter of approximately 3 feet or larger;

a plurality of toothed, roller cutters, support means depending from said lower surface on the lower end of said body rotatably mounting each of said cutters on a fixed axis generally parallel to said flat surface; and magnetic means mounted on and depending from said lower surface adjacent to and between said cutters to be moved closely adjacent to the bottom of the drill bore as the drill bit rotates to attract magnetic debris on the bottom of the drill bore and thereby remove such debris from the path of said cutters.

2. The assembly of claim 1 wherein said magnetic means extends from the periphery of the drill body generally towards the center of the body so that the magnetic means sweeps over most of the drill bore as said assembly is rotated.

3. The assembly of claim 1 wherein said cutter means includes a plurality of cutters separately rotatably mounted on said body and said magnetic means includes a magnetic member mounted adjacent each of said cutters.

4. The assembly of claim 3 including a flexible flap attached to said body adjacent each of said cutters with said magnetic member mounted on said flexible flap.

5. The assembly of claim 3 wherein each of said magnetic members is positioned immediately in front of its cutter so that it leads the cutter as the assembly is rotated.

6. A drill bit assembly comprising:

a drill bit body for connection to means for rotating the assembly during a drilling operation;

cutter means rotatably mounted on the lower end of said body; and magnetic means mounted on said lower end adjacent said cutter means to be moved closely adjacent to the bottom of the drill bore as the drill bit rotates to attract magnetic debris on the bottom of the drill bore, said cutter means includes a plurality of cutters rotatably mounted on said drill body, and said drill body includes a hole extending through the body and opening to the bottom of the bore and includes recesses in its outer periphery extending inwardly with respect to the cutters located on the outer periphery so that drilling fluid may flow through said hole past said cutters and through said recesses in flushing cuttings out of the drilling bore.

7. A drill bit assembly comprising:

a drill bit body for connection to means for rotating the assembly during a drilling operation;

cutter means rotatably mounted on the lower end of said body;

a flexible flap mounted on the lower end of said body; and magnetic means mounted on said flap adjacent said cutter means to be moved closely adjacent to the bottom of the drill bore as the drill bit rotates to attract magnetic debris on the bottom of the drill bore.

8. A drill bit assembly comprising:

a drill bit body for connection to means for rotating the assembly during a drilling operation;

cutter means rotatably mounted on the lower end of said body;

magnetic means mounted on said lower end adjacent said cutter means to be moved closely adjacent to the bottom of the drill bore as the drill bit rotates to attract magnetic debris on the bottom of the drill bore, said magnetic means extending from the periphery of the drill body generally towards the center of the body so that the magnetic means sweeps over most of the drill bore as said assembly is rotated; and an elongated pick-up slot formed in said drill body and extending adjacent said magnetic means for sucking drill cuttings from the bottom of the drill bore as the assembly rotates.

9. The assembly of claim 8 wherein said magnetic means is located on the trailing edge of said slot as the assembly rotates so that the magnetic means will capture the magnetic particles which are not sucked through said slot.

10. A drill bit assembly comprising:

a drill bit body for connection to means for rotating the assembly during a drilling operation;

cutter means rotatably mounted on the lower end of said body;

means rotatably mounted on the bottom of said body for rolling on the drilling bore as the assembly rotates; and magnetic means mounted on said rolling means to capture magnetic particles on the bottom of the drill bore.

11. The assembly of claim 10 including hopper means mounted on said drill body adjacent said rolling means to scrape said rolling means and receive the magnetic particles captured by said rolling means.

12. The assembly of claim 10 wherein said rolling means comprises resilient tires and said magnetic means are positioned within said tires so that the magnetic debirs is captured on the exterior of said tires.

13. A drill bit assembly comprising:

a drill bit body having a large diameter lower portion with a generally flat bottom surface;

a plurality of cutters rotatably mounted on the bottom surface of said body arranged to cut a large diameter bore as the drill body is rotated, a group of said cutters being mounted on the periphery of said body, and said body having inwardly extending recesses in its periphery between said peripheral cutters so that said recesses form spaces through which drilling fluid can circulate for removing particles from the drill bore, said drill body further having a hole extending therethrough for circulating drilling fluid through the space between the bottom of the bore and bottom surface of the drill body; and a plurality of flexible flaps attached to the lower surface of said body and carrying magnetic means for capturing magnetic debris which is not washed away by said drilling fluid.

14. In drilling large diameter bores in the earth using a plurality of rotatably mounted cutters on the bottom of a drill bit, a method of removing cuttings and debris from the bottom of the drill bore comprising the steps of:

circulating drilling fluid across the bottom of the drill bore beneath the bottom of the drill body adjacent the cutters; and moving magnetic means over the bottom of the drilling bore attached to the bottom of said drill body with the magnetic means being close to the bore bottom, said magnetic means being positioned adjacent each of said cutters so that as the drill bit is rotated, the magnetic means leads the cutters.

15. In drilling large diameter bores in the earth using a plurality of rotatably mounted cutters on the bottom of a drill bit, a method of removing cuttings and debris from the bottom of the drill bore comprising the steps of:

circulating drilling fluid across the bottom of the drill bore beneath the bottom of the drill body adjacent the cutters; and moving magnetic means over the bottom of the drilling bore attached to the bottom of said drill body with the magnetic means being close to the bore bottom, said drilling fluid being circulated through the space between the drill body and the surrounding drill bore and upwardly through a radially extending slot formed in said drill body, said magnetic means being positioned on the trailing side of said slot to capture the magnetic debris which is not drawn upwardly through said slot.

16. In drilling large diameter bores in the earth using a plurality of rotatably mounted cutters on the bottom of a drill bit, a method of removing cuttings and debris from the bottom of the drill bore comprising the steps of:

circulating drilling fluid across the bottom of the drill bore beneath the bottom of the drill body adjacent the cutters; and moving magnetic means over the bottom of the drilling bore attached to the bottom of said drill body with the magnetic means being close to the bore bottom, said magnetic means being rotatably mounted on the bottom of said drill body so that the magnetic means is rolled over the bottom of the drill bore as the drill body is rotated.

17. The method of claim 16 wherein said rolling member means are scraped against hopper means to collect the magnetic debris which is attracted to the exterior of said rolling means.

* * * * *